US005398032A

United States Patent [19]

Tucker et al.

[11] Patent Number: 5,398,032

[45] Date of Patent: Mar. 14, 1995

[54] TOWED MULTI-BAND DECOY

[75] Inventors: Trevor W. Tucker, Carp; William B. Vigder, Nepean; Charles E. Zwicker, Nepean; John K. Schreiber, Nepean, all of Canada

[73] Assignee: TTI Tactical Technologies Inc., Kanata, Canada

[21] Appl. No.: 246,924

[22] Filed: May 20, 1994

Related U.S. Application Data

[63] Continuation of Ser. No. 904,714, Jun. 20, 1992, abandoned.

[30] Foreign Application Priority Data

Jun. 28, 1991 [GB] United Kingdom ..... 9114052

[51] Int. Cl.[6] ..... H01Q 15/20

[52] U.S. Cl. ..... 342/9; 342/8; 342/10

[58] Field of Search ..... 342/8, 9, 10

[56] References Cited

U.S. PATENT DOCUMENTS

| | | | |
|---|---|---|---|
| 2,419,549 | 4/1947 | Griesinger et al. | 342/9 X |
| 2,576,255 | 11/1951 | Hudspeth et al. | 342/8 |
| 2,731,046 | 1/1956 | Bachner | 342/9 X |
| 2,805,065 | 9/1957 | Cotton | 342/9 X |
| 2,821,396 | 1/1958 | Seeley | 342/9 X |
| 2,978,700 | 4/1961 | Stevens et al. | 342/9 |
| 3,010,103 | 11/1961 | Hopper et al. | 342/9 |
| 3,114,911 | 12/1963 | McNutt | 342/9 |
| 3,121,227 | 2/1964 | Franklin | 342/9 |
| 3,241,142 | 3/1966 | Raabe | 342/355 |
| 3,296,617 | 1/1967 | Rogallo | 342/8 |
| 3,568,191 | 3/1971 | Hiester et al. | 342/8 |
| 3,671,965 | 6/1972 | Rabenhorst et al. | 342/8 |
| 4,028,701 | 6/1977 | Parks et al. | 342/8 |
| 4,119,965 | 10/1978 | Kaszyk | 342/8 |
| 4,195,298 | 3/1980 | Firth | 342/8 |
| 4,540,987 | 9/1985 | Werkes et al. | 342/10 |
| 4,695,841 | 9/1987 | Billard | 342/8 |
| 4,709,235 | 11/1987 | Graham, Jr. et al. | 342/10 |
| 4,901,081 | 2/1990 | Bain, Jr. et al. | 342/8 |
| 4,928,130 | 5/1990 | Pfabe et al. | 342/9 |
| 5,345,238 | 9/1994 | Eldridge et al. | 342/3 |

FOREIGN PATENT DOCUMENTS

| | | | |
|---|---|---|---|
| 2930936 | 7/1985 | Germany | 342/9 |
| 0758090 | 9/1956 | United Kingdom | 342/8 |

*Primary Examiner*—John B. Sotomayor
*Attorney, Agent, or Firm*—Pascal & Associates

[57] ABSTRACT

The towed multi-band radar decoy or target is a collapsible, airstream-inflatable device intended to be used for providing gunnery practice or electronic countermeasure protection for aircraft against radars and radar-guided missiles by being towed on a line behind the aircraft and offering a more attractive radar target than the aircraft for the radar or radar guided missile to track and home on. The decoy or target is collapsible, so that many can be stored in a small space, and can be deployed while an aircraft is airborne. The decoy is comprised of a sleeve of radar-transparent fabric having a tapered cylindrical shape and an open mouth at a narrow end, and clusters of orthogonal trihedral corners formed from flat conductive surfaces fixed inside and to said sleeve which can be folded and collapsed into a small space, and once inflated, for providing a radar reflective signature which exceeds that of a towing aircraft over predetermined angular aspects.

9 Claims, 2 Drawing Sheets

TOWED MULTI-BAND DECOY

RELATED APPLICATION DATA

This application is a continuation of Ser. No. 07/904,714, filed Jun. 20, 1992, which is now abandoned.

FIELD OF THE INVENTION

This invention relates to radar countermeasure missile decoys and radar gunnery practise targets.

BACKGROUND TO THE INVENTION

An aircraft which is illuminated by a radar or radar-guided missile can provide an alternate radar target by the use of a physically separate (towed) decoy which is more attractive to the radar or radar-guided missile than that of the aircraft. A more attractive target means generally that the decoy's radar signature is stronger than that of the aircraft and that it contains amplitude and frequency modulation features such that the radar, using advanced signal processing techniques, cannot discriminate between the aircraft and the decoy by exploiting such modulation features (and hence select the aircraft).

At present there are three basic approaches for implementing towed countermeasure decoys. The first approach is the use of an active repeater (amplifier) in the towed body which contains a receive antenna, a transmit antenna (which may be time shared with the receive antenna), an amplifier to increase the decoy's signature power over the aircraft's signature power (when they are received at the radar) and a modulator to provide the appropriate frequency and amplitude modulation so that the radar cannot use modulation characteristics to discriminate between the decoy and the aircraft. In this implementation of the towed decoy, the primary (ac or DC) power source may be contained within the towed body or contained within the aircraft.

The second approach is the use of an active repeater similar to that described above, but housed in the aircraft, and re-radiating the decoy signal from an antenna at the end of a tow-line by propagating the decoy signal down a low loss radio frequency surface wave line (also called a Goubau line) to the re-radiating antenna. This is described in the publication "Surface Waves and Their Applications to Transmission Lines", G. Goubau, Journal of Applied Physics, vol. 21, pp. 1119–1128, November, 1950.

The third approach is the use of an active repeater (similar to that described above) in the aircraft and re-radiating the decoy signal from an antenna in the towed body at the end of the tow-line in a manner similar to that of the second approach above, except the radio frequency line connecting the towed body to the aircraft may or may not be a Goubau line and the towed body will always have an amplifier housed within it to provide additional power to the radiated signature of the decoy.

The primary limitations of the above approaches are that the frequency range over which each of the decoys can respond is limited to the bandwidth of the repeater amplifier, which is typically a travelling wave tube amplifier possessing a bandwidth of one to one and a half octaves.

The power of the decoy signature is limited by the output power of the decoy's power amplifier. This output power limitation simply corresponds to the output saturation power of the travelling wave tube or other output power tube. This limitation means that at sufficiently close range separation between the radar and the aircraft, the output (signature) power of the decoy will attain its maximum (saturation power) while the signature from the aircraft continues to increase as range closes and the signature power of the aircraft received at the radar will ultimately become greater than that of the decoy at sufficiently close range. Under this condition the decoy loses its countermeasure effectiveness.

The tow lines used in the aforenoted implementations (in order that they may transmit from the aircraft to the towed body the required direct current, alternating current or radio frequency power) must be metallic and relatively non-stretchable. Unless a means for artificially slowing the decoy is used during the deployment process with such lines, the line diameter required to withstand the impulse force upon the decoy reaching the end of the line is sufficiently large that line storage is difficult and aerodynamic drag from the line alone is large after deployment. The use of a slowing mechanism or brake also increases the deployment time and reduces decoy effectiveness when deployment must be immediate to counter an imminent threat. The metallic line itself also provides a very large reflective radar signature when viewed side-on which negates the effectiveness of the signature radiated from the antenna at the end of the line for select broadside angles.

On the other hand, a radar target is formed of arrays of passive reflectors contained within a rigid radar-transparent cylinder, having a reflection signature which is similar to that of an airplane. U.K. patents 1,523,268 published Aug. 31, 1978 and 916,067 published Jan. 16, 1963 describe various radar reflective structures in a towable gunnery target, which structures are held within a rigid aerodynamic shell.

SUMMARY OF THE INVENTION

The present invention is comprised of collapsible arrays of passive radar reflectors, whose dimensions and orientation once deployed are such that the radar signature (radar cross-section) of the decoy exceeds that of the towing or launching aircraft over a substantial portion of its angular aspect. The reflectors are sheathed in an inflatable outer sleeve designed to enhance the aerodynamic properties of the device (i.e. reduce aerodynamic drag and enhance flight and stability). The decoy is manufactured from lightweight fabric and foldable structures which can be stored in a small volume and which will rapidly inflate to its operational configuration after being launched into the airstream of the aircraft. Consequently many can be stored in a small space and deployed on demand during a combat situation.

In accordance with an embodiment of the invention, a radar countermeasure decoy for towing behind an aircraft is comprised of a collapsible sleeve of radar-transparent fabric having a generally tapered shape at least toward its front end, and a generally cylindrical shape and an open mouth at its narrow front end, and clusters of orthogonal trihedral corners formed from foldable flat conductive surfaces fixed inside and to the sleeve for providing a radar reflective signature which exceeds that of a towing aircraft over predetermined angular aspects.

In accordance with another embodiment of the invention, a radar countermeasure collapsible decoy for towing behind an aircraft is comprised of clusters of orthogonal trihedral corners formed from flat conductive collapsible surfaces, for inflating and providing a radar reflective signature which exceeds that of a towing aircraft over predetermined angular aspects when deployed.

It should be noted that the term "decoy" used in this specification should be construed to mean decoy or target by aircraft, remotely piloted vehicle, drone or whether towed in free flight, etc., since the inventive concept can be used for either.

U.S. Pat. No. 4,709,235 issued Nov. 24, 1987 describes a decoy which is formed of a collapsible radar reflective shroud. The structure makes no provision for deploying efficient reflective surfaces contained within a radar-transparent sleeve, as in the present invention. Neither this nor the aforementioned patents provided an efficient collapsible decoy or target in which internal radar reflective structures define the decoy or target signature, and which can be deployed at will from an aircraft.

BRIEF INTRODUCTION TO THE DRAWINGS

A better understanding of the invention will be obtained by reference to the detailed description below, in conjunction with the following drawings, in which:

FIG. 1 is a drawing of clusters of radar reflectors, in a form after deployment, FIG. 2 is a drawing of an inflated collapsible outer sleeve within which the radar reflectors are retained, FIG. 3 is a graph of computed radar cross-section (RCS) resulting from radar reflection, relative to aspect angle, and FIG. 4 is a drawing of a spoked structure, looking head on into the axis of the decoy, for supporting radar reflecting panels in the decoy.

DETAILED DESCRIPTION OF THE INVENTION

Figure 1:
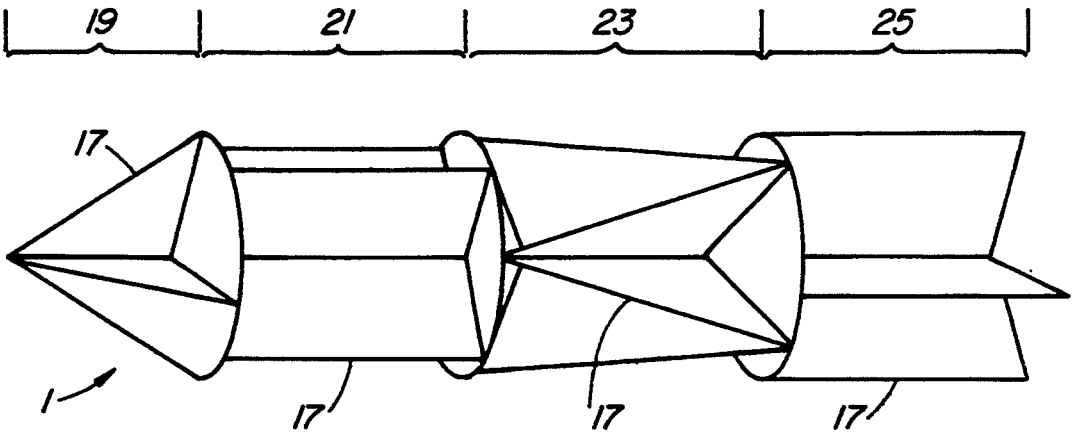
Figure 2:
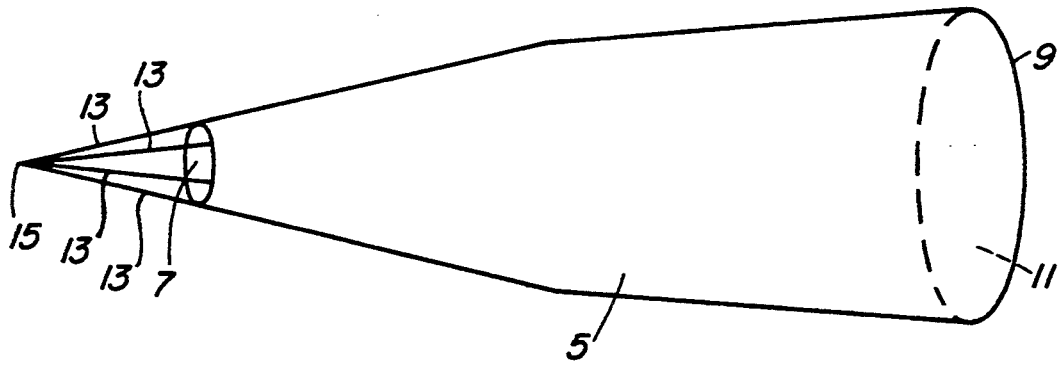

The towed multi-band decoy is a device for protecting military aircraft against radar guided or controlled weapons and missiles. The device in accordance with the present invention is comprised of collapsible arrays 1 of passive radar reflectors whose dimensions and orientation are such that the radar signature (radar cross-section) of the decoy exceeds that of the towing or launching aircraft over a substantial portion of its angular aspect as shown in FIG. 1 or, as a target, mimics the radar signature of a predetermined aircraft. The reflectors are sheathed in a collapsible and inflatable outer sleeve 5, e.g. as shown in FIG. 2, designed to both inflate from a collapsed condition and enhance the aerodynamic properties of the decoy (i.e. reduce aerodynamic drag and enhance flight stability). The decoy is manufactured from lightweight fabric and foldable structures which can be stored in a small volume and which will rapidly inflate to its operational configuration after being launched into the airstream of the aircraft.

The preferred embodiment of decoy is comprised of:

(a) a tapered substantially cylindrically shaped outer sleeve 5 of non-porous fabric with a smaller diameter open forward end 7 and a larger diameter closed rearward end 9, (b) a flat, slightly porous rear panel 11 forming an abrupt tail to the decoy, (c) several rigging lines 13 evenly spaced around the tapered substantially cylindrical sleeve running lengthwise along the decoy body and joined together at 15 forward of the front end of the sleeve, (d) several internal collapsible spoked mechanisms (FIG. 4) to provide internal structure to the decoy, (e) radar-reflective panels 17 made of flexible metallized mesh or film material, supported by the rigging lines, by other internal reinforcing lines, by the internal spokes and by the outer sleeve when inflated.

Radar Reflectors

As noted above radar reflectors are sheathed inside the decoy's aerodynamic sleeve 5 and are comprised of clusters of substantially flat metallic surfaces 17 formed into dihedral and trihedral (right angle two- and three-sided) corners as shown in FIG. 1. Each individual corner reflector has an associated RCS (radar cross-section) which is determined by the size and shape of its component surfaces and by the frequency of the impinging radar signal. The dimensions of the corners are therefore dictated by the magnitude of the RCS of the aircraft to be protected, and by the lower limit of the frequency band of the threat radar systems of concern. The relationship between the dimensions of a reflective corner and its RCS has been characterized by several scientific authors.

Microwave reflective characteristics of metallic plates, dihedral and trihedral and other corners is well known, for example as described in "Radar Cross Section, Its Prediction, Measurement and Reduction", E. F. Knott, J. R. Schaeffer and M. T. Tuley, Artech House, 1985, and "Trihedral Radar Reflector", A. Macikunas, S. Haykin and T. Greenlay, Canadian Patent 1,238,400, issued Jun. 21, 1988. The present invention on the other hand provides for shaping and configuring a number of such microwave reflectors in a cluster from a collapsed to a deployed condition to provide an aggregate radar cross-section for the decoy which exceeds that of the towing aircraft for most aspect angles or which mimics that of a predetermined aircraft when used as a target.

In addition this invention provides for amplitude and frequency modulation of the reflected signal by physically rotating and vibrating the position and configuration of the plates and corners. Also the invention provides for both monostatic and bistatic radar cross-sections which result from the rotation and vibration of the plates and corners.

The number and orientation of the corner reflectors are determined by the RCS profile of the aircraft being protected. While being towed, the decoy heading and aircraft heading are approximately the same and so both aircraft and decoy are seen from the same perspective by a remote radar. The RCS profile when used as a decoy should exceed that of the aircraft over as large an angular aspect range as possible. This can be done by measuring the RCS of the aircraft as a function of aspect angle and selecting the size, position and number of corners so that their combined RCS exceeds that of the aircraft over the aspect angles of interest.

If the decoy is not being towed, but is instead in free flight through inertia or a separate power source, the relative aspect angle between the aircraft and decoy is not known. Therefore the corner reflectors should be oriented to provide a roughly uniform RCS over all perspectives.

The direction of maximum RCS generated by each trihedral corner, called the directional axis of the corner, is close to a line extending equiangularly between its three faces, and as the direction of the illumination deviates from this axis, its RCS diminishes. The RCS lobe generated by this change in illumination direction is contained within an angular range of approximately +/−45° in both azimuth and elevation. To create a large RCS over a wide angular aspect range, the corners should be arranged in groups such that their directional axes are offset from one another by 45° or less over the aspect range of interest.

As an example of a useful corner configuration, FIG. 1 shows one grouping of corners in which the RCS has been tailored to cover all viewing perspectives except for nose-on and tail-on perspectives. If the decoy is 70" long with a diameter of 18", then this corner grouping would provide an RCS which, on average, exceeds that of the B-26 bomber for most angles and for frequencies above 6 gigahertz. Reference is made to the texts "Introduction to Radar Systems", M. Skolnik, McGraw-Hill, 1980, p. 40 and "Airborne Early Warning Radar", W. L. Morchin, Artech House, 1990, P.76.

FIG. 1 shows four sections to the decoy: a nose 19, two midsections 21 and 23 and a tail 25. Each section is composed of an array of trihedral corners.

The nose section 19 contains four trihedral corners with directional axes pointed forward and offset 45° from the longitudinal axis of the decoy. The directional axes are uniformly spaced at 90° increments in roll angle about the body of the decoy.

The first mid-section 21 directly behind the nose array contains eight trihedral corners. Four of the corners form an array with directional axes similar to the nose array, except the array is offset in roll angle to the nose array by 45°. The other four corners have directional axes which point rearward and are offset 45° from the longitudinal axis of the decoy. These directional axes are also uniformly spaced at 90° increments in roll angle about the body of the decoy.

The second mid-section 23 contains eight trihedral corners with directional axes pointing at 90° to the longitudinal axis of the decoy, uniformly spaced at 45° increments in roll angle.

The final tail section 25 contains four trihedrals whose directional axes are pointed in a similar fashion to the nose array, except the tail trihedrals point rearward.

The nose, tail, and first mid-section also contain dihedral corners which create a strong broadside RCS over a narrow viewing angle.

Figure 3:
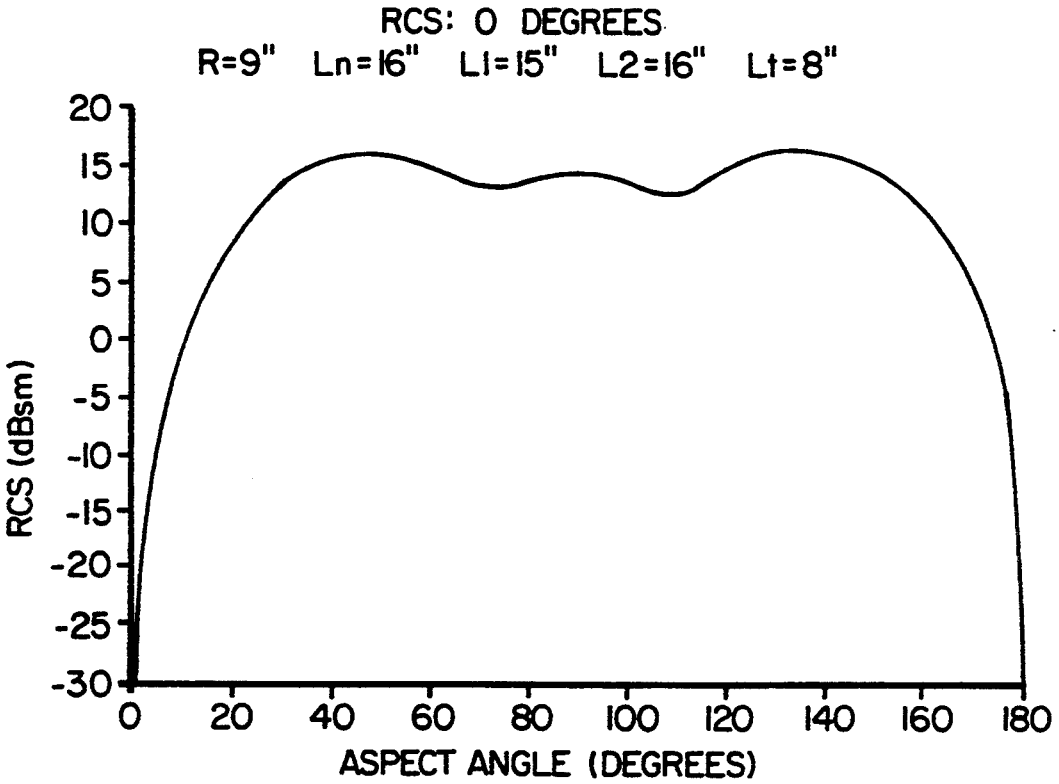

The net effect of this arrangement of reflectors is shown in a computed RCS plot in FIG. 3. For this plot, a decoy length of 63" and diameter of 18" was selected. It may be seen that the decoy RCS remains fairly constant over a range of pitch angles from 30° to 160°.

The reflective panels 17 of the dihedral and trihedral corners are made from a flexible mesh, netting or film upon which a conductive coating has been painted or otherwise deposited. The fabric should be strong, lightweight and flexible to allow the decoy to be folded for storage. Suitable materials for the panel fabric include NYLON TM, DACRON TM, MYLAR TM or KEVLAR TM. The conductive material may be a silver, aluminum or copper impregnated paint, coating or deposit.

Aerodynamic Outer Sleeve

The outer sleeve 5 of the decoy serves two purposes: it provides a frame on which to form the reflective corners once deployed, and it provides an aerodynamic shape to reduce drag and increase flight stability. The outer sleeve is firmly attached to the conductive mesh of the internal corner reflectors. When launched from an aircraft, the outer sleeve rapidly inflates with air from the airstream, unfolding the conductive mesh and pulling the conductive corners taut.

To achieve low aerodynamic drag and stable flight, the outer sleeve 5 of the decoy is made from a lightweight, non-porous, slippery fabric such as the zero-porosity NYLON TM used in parachute manufacturing. The fabric must be strong to withstand buffeting and drag forces, and it must be transparent to the radar frequencies of interest. At least the front portion of the inflated decoy should be tapered, with a small opening at the forward end 7 and a larger closed rearward end 9 and the remainder of the decoy can be cylindrical of round, 8 sided or other suitable cross-section. The rear panel 11 of the outer sleeve should be substantially flat when the decoy is inflated, to ensure flight stability, and it must be slightly porous to allow a slight amount of air through in order to reduce drag. Some of the conductive mesh surfaces forming the reflective corners may extend partially or completely out of the periphery of the aerodynamic sleeve. Connection of these surfaces to the sleeve is achieved with rigging lines.

Rigging Lines

The decoy is towed by several rigging lines 13 which run longitudinally down the length of the decoy, which are firmly attached to the sides of the sleeve and to the radar-reflective surfaces, and which are joined together at a point 15 forward of the front end of the outer sleeve 5. For the reflective corner arrangement illustrated in FIG. 1, the rigging lines are attached to the outer edges of the surfaces which form the nose array. As the lines pull taut from the drag associated with the decoy while being deployed and then towed, the nose surfaces are stretched and flattened to provide good reflective properties.

Spoked Mechanism

Figure 4:
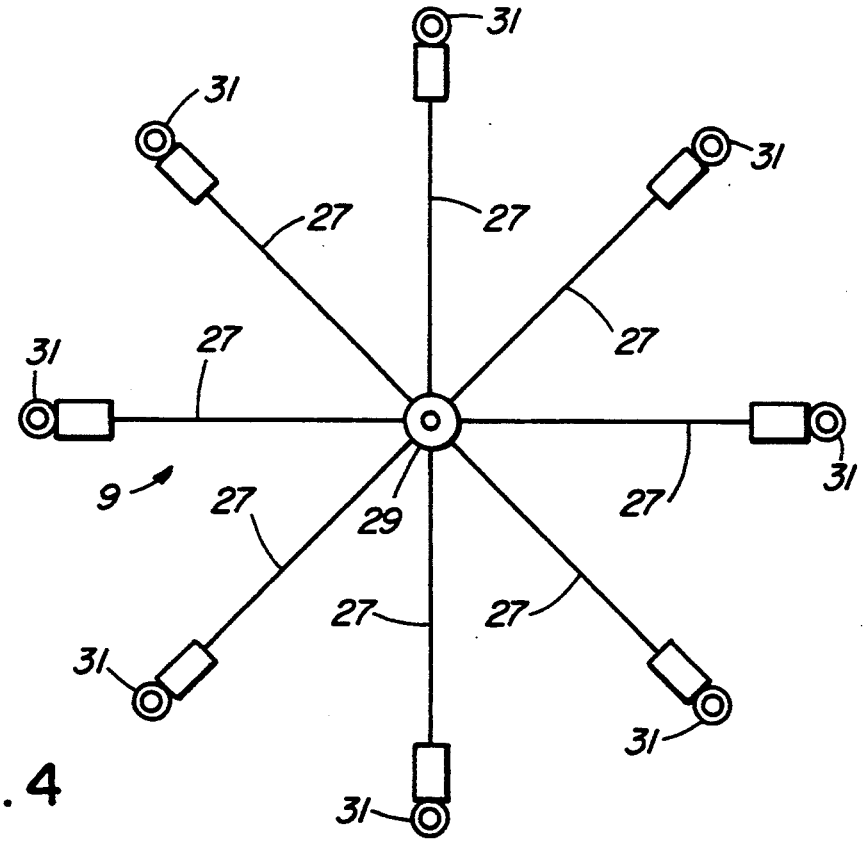

The reflective corners are preferred to be given support after deployment and inflation of the sleeve by one or more collapsible spoked mechanisms as shown in FIG. 4. A preferred form of mechanism is comprised of eight spokes 27 attached at hinged points to a central hub 29 similar to the manner in which the spokes of an umbrella are attached to its central rod. Each mechanism is positioned with its hub orthogonal to the axis of the sleeve inside the aerodynamic sleeve 5 and is attached at its centre to a rigging line which runs down the longitudinal axis of the decoy. The outer edges 31 of the spokes are attached to rigging lines which run along the inside of the outer sleeve. Under decoy drag force, the rigging lines force the spokes of the mechanism to fully extend, thus placing the reflective surfaces into their correct positions.

Each mechanism is covered with conductive mesh which forms a substantially flat conductive surface positioned cross-wise in the decoy when the spokes extend. The spokes also attach to and provide support for the mesh surfaces which run longitudinally in the decoy.

RCS Modulation

When towed at aircraft speeds through the air, the individual surfaces and corners of the foldable decoy vibrate naturally as a result of the aerodynamic forces on the towed body, modulating its radar signature. The surfaces and corners may also be vibrated and/or rotated with respect to one another, for example using air pressure differentials from the airstream flow around the towed body of the decoy, using appropriate rotation and vibration mechanisms such as curved, flexible fins, reeds and tubes, to provide amplitude and frequency modulation of the radar signature. Curved fins may be affixed at the rearward end of the decoy to interact with the airstream and provide a rotational force. The reeds and tubes may be affixed directly to the flat conductive surfaces, to their supporting lines or to the aerodynamic sleeve, and cause the surfaces to vibrate at frequencies from approximately 100 Hz to 10 kHz or more. Such modulation makes it difficult for advanced radars to discriminate between the aircraft and decoy based on the modulation characteristics of their respective radar signatures.

In addition, such rotation and vibration of the reflective surfaces relative to one another alter the direction of reflection from being purely retrodirective (i.e. incident and reflected signals on the same bearing) for right angle corners, to non-retrodirective for other than right angle corners. This altering or steering of the reflected beam provides a substantial bistatic radar cross-section over select angles which may be designed to provide decoy protection against semi-active and track-via-missile radar seekers. Such missile systems possess a receive antenna in the missile, but the transmitter is located on the launching platform (either surface-based or airborne). For decoy effectiveness against such systems the decoy must offer both monostatic and bistatic radar cross-sections, which is the result achieved by the present invention.

A person understanding this invention may now conceive of alternative structures and embodiments or variations of the above. All of those which fall within the scope of the claims appended hereto are considered to be part of the present invention.

We claim:

1. A radar countermeasure decoy or training target for towing behind an airborne vehicle and inflating from a collapsed condition due to drag forces, comprised of an inflatable sleeve, collapsible clusters of orthogonal trihedral corners formed from substantially flat conductive surfaces contained within and coupled to the sleeve and erected due to inflation of the sleeve for providing a radar reflective signature which exceeds that of a towing aircraft or mimics the radar signature of a predetermined aircraft over predetermined angular aspects and further including at least one foldable umbrella-like spoked structure coupled to said sleeve to which the conductive surfaces are fastened, the foldable spoked structure extending or inflating into a deployed position from a collapsed condition with inflation of said sleeve thereby holding said surfaces in predetermined positions relative to each other and forming said orthogonal trihedral corners.

2. A decoy or target as defined in claim 1 wherein said conductive surfaces are comprised of flexible metallized mesh, fabric or film.

3. A decoy or target as defined in claim 2 wherein said clusters are sheathed in a flexible radar-transparent outer sleeve.

4. A decoy or target as defined in claim 3 in which said sleeve is in the form of a cylinder tapered at least toward its front end having a narrow open mouth for facing the direction of decoy flight, and a wider, substantially flat back panel at its rearward end.

5. A decoy or target as defined in claim 4 in which said sleeve is comprised of non-porous fabric and the back panel is comprised of a slightly porous fabric, whereby when the decoy is towed from an aircraft, the sleeve is inflated in the resulting airstream, drag forces holding said surfaces at right angle positions relative to each other.

6. A decoy or target as defined in claim 4, further including means for vibrating and/or rotating of at least some of said surfaces to cause amplitude and frequency modulation of the radar signature of the decoy.

7. A decoy or target as defined in claim 5, further including means for vibrating and/or rotating at least some of said surfaces to cause amplitude and frequency modulation of the radar signature of the decoy.

8. A radar or target countermeasure decoy for towing behind an airborne vehicle comprised of a collapsible sleeve of radar-transparent fabric having a tapered cylindrical shape and an open mouth at a narrow end, and collapsible clusters of orthogonal trihedral corners formed from flat conductive surfaces fixed inside and to said sleeve for providing a radar reflective signature which exceeds that of a towing aircraft or mimics a radar reflective signature of a predetermined aircraft over predetermined angular aspects, once deployed, further including at least one flexible spoked structure to which the conducting surfaces are fastened coupled to said sleeve, the foldable spoked structure extending or inflating with said sleeve from a collapsed position into a deployed position thereby holding said surfaces in positions relative to each other and forming said orthogonal trihedral corners.

9. A decoy or target as defined in claim 8 in which said sleeve and said surfaces are flexible and foldable, and further including rigging lines attached to the decoy for pulling the decoy with its open mouth narrow end forward, whereby when the decoy is towed from an aircraft, the sleeve is inflated in the resulting airstream from a collapsed condition, drag forces holding said surfaces at right angle positions relative to each other.

* * * * *